US008743141B2

(12) United States Patent
Morovic et al.

(10) Patent No.: US 8,743,141 B2
(45) Date of Patent: Jun. 3, 2014

(54) COLOR LOOKUP TABLE SMOOTHING EMPLOYING NODE ADJUSTMENT PROPAGATION

(75) Inventors: Peter Morovic, Barcelona (ES); Jan Morovic, Colchester (GB); Manuel Ángel Albarrán Moyo, Barcelona (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 286 days.

(21) Appl. No.: 13/241,095

(22) Filed: Sep. 22, 2011

(65) Prior Publication Data

US 2013/0076778 A1 Mar. 28, 2013

(51) Int. Cl.
*G09G 5/02* (2006.01)

(52) U.S. Cl.
USPC ..... 345/601; 345/589; 345/591; 345/600; 345/602; 358/3.23; 358/518

(58) Field of Classification Search
USPC ..... 345/600–602, 589, 591; 358/1.9, 518, 358/3.23
See application file for complete search history.

(56) References Cited

U.S. PATENT DOCUMENTS

| | | | | |
|---|---|---|---|---|
| 5,739,927 | A * | 4/1998 | Balasubramanian et al. | 358/518 |
| 5,947,899 | A * | 9/1999 | Winslow et al. | 600/410 |
| 6,522,427 | B1 | 2/2003 | Bhattacharjya et al. | |
| 7,382,489 | B2 | 6/2008 | Curry et al. | |
| 7,456,997 | B2 | 11/2008 | Pethania et al. | |
| 7,768,682 | B2 * | 8/2010 | Mestha et al. | 358/518 |
| 2003/0044061 | A1 * | 3/2003 | Prempraneerach et al. | 382/164 |
| 2006/0041609 | A1 | 2/2006 | Pellar | |
| 2009/0161183 | A1 | 6/2009 | Schweid et al. | |
| 2010/0085605 | A1 * | 4/2010 | Shaw et al. | 358/3.23 |
| 2010/0157331 | A1 | 6/2010 | Shestak | |
| 2010/0220111 | A1 | 9/2010 | Stauder et al. | |
| 2011/0038010 | A1 | 2/2011 | Chen et al. | |

* cited by examiner

*Primary Examiner* — Xiao Wu
*Assistant Examiner* — Todd Buttram

(57) ABSTRACT

Color lookup table smoothing employs propagation of a portion of an adjustment of a modified node to an unmodified node of a color lookup table (CLUT).

20 Claims, 3 Drawing Sheets

COLOR LOOKUP TABLE SMOOTHING EMPLOYING NODE ADJUSTMENT PROPAGATION

CROSS-REFERENCE TO RELATED APPLICATIONS

N/A

STATEMENT REGARDING FEDERALLY SPONSORED RESEARCH OR DEVELOPMENT

N/A

BACKGROUND

Color lookup tables (CLUTs) are data structures that provide a transformation or mapping of a first set of colors into a second set of colors. For example, a CLUT may be used to map colors, typically represented by numerical values, as captured by an imaging device (e.g., a camera, a scanner, etc.) into a device-dependent color space of a particular output device or class or devices. Generally, the device-dependent color space is based on either an additive color model or a subtractive color model. For example, display devices such as, but not limited to, computer displays, monitors and projectors often employ an additive color model known as a red-green-blue (RGB) color model. Output devices including, but not limited to, printers typically employ a subtractive color model such as a cyan-magenta-yellow-key (CMYK) color model. In another example, a CLUT may provide a mapping between a device-dependent color space and a device-independent color space. For example, the CLUT may map a device-dependent color space of an input device (e.g., an imaging device) to a device-independent color space used for image processing within a computer. Alternatively, the CLUT may be used to map the device-independent color space into a color space (e.g., RGB) of an output device (e.g., a display), for example. In some examples, the mapping provided by the CLUT between the device-dependent and device-independent color spaces is bidirectional while in other examples the mapping is uni-directional.

A CLUT also provides means for reducing a size or an amount of data used to represent a particular image in terms of a color space. In particular, the CLUT may represent a large number of possible colors of a specific color space in terms of a relatively smaller number of nodes within the color space. The nodes form a mesh or matrix of discrete colors from which all of the colors of the color space may be recreated using an interpolation between the nodes. By representing a larger color space with a relatively smaller number of nodes in conjunction with interpolation, data storage requirements for the CLUT may be significantly reduced.

In some examples, a CLUT may be employed by a color management system in conjunction with an ICC profile according to standards promulgated by the International Color Consortium (ICC). An ICC profile describes or defines color attributes of a specific device in terms of a target color space and a profile connection space (PCS). The color attributes of the specific device include the device-dependent color space while PCS represents an example of a device-independent color space. The PCS may be one of the Commission Internationale de L'éclairage (CIE) L* a* b* (CIELAB) or the CIE XYZ (CIEXYZ) color spaces, for example. According to some examples, the CLUT is used in conjunction with or as part of the ICC profile to provide the mapping between (either to or from) the PCS and the device-dependent color space of the specific device as specified by the ICC profile.

In creating and using CLUTs, it is often useful to modify a value of a node. In some examples, the node may be manually modified (e.g. by a user) while in other instances, the node is modified substantially automatically by a profile adjustment tool, for example. The modification of a node may, in turn, introduce a discontinuity in an effective color space represented by the CLUT. Unfortunately, discontinuities or abrupt, 'unsmooth' variations in node values between neighboring nodes of the CLUT may result in visual artifacts when the CLUT is employed. The visual artifacts may degrade an image processed using the CLUT, for example.

BRIEF DESCRIPTION OF THE DRAWINGS

Various features of examples in accordance with the principles described herein may be more readily understood with reference to the following detailed description taken in conjunction with the accompanying drawings, where like reference numerals designate like structural elements, and in which.

Figure 1:
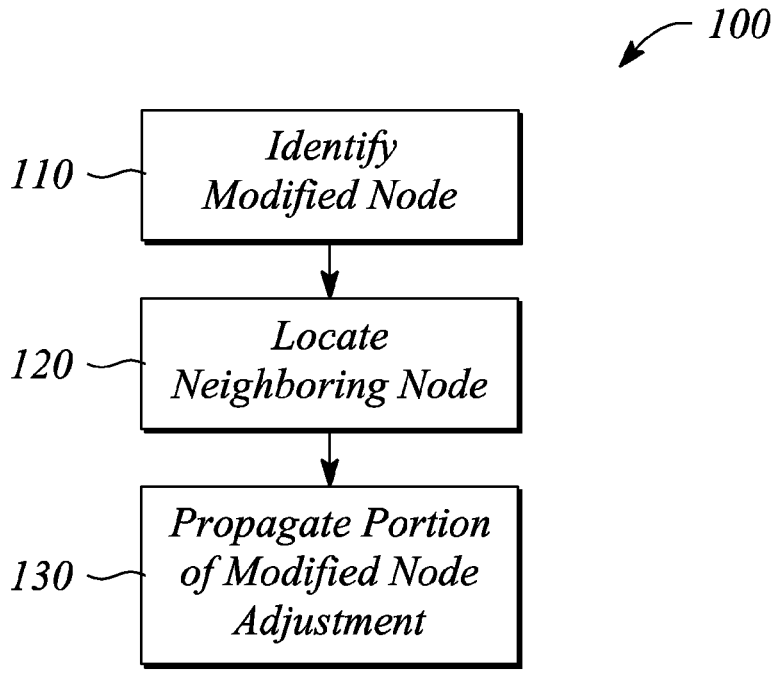
FIG. 1 illustrates a flow chart of a method of smoothing a color lookup table, according to an example in accordance with the principles described herein.

Certain examples have other features that are one of in addition to and in lieu of the features illustrated in the above-referenced figures. These and other features are detailed below with reference to the above-referenced figures.

DETAILED DESCRIPTION

Examples in accordance with the principles described herein provide smoothing of a color lookup table (CLUT) having a modified node. In particular, examples in accordance with the principles described herein provide CLUT smoothing that propagates an adjustment of a modified node to adjacent or surrounding unmodified nodes. The node adjustment propagation distributes a portion of the adjustment to the unmodified nodes without affecting the modified node. Propagating the adjustment may reduce or mitigate artifacts caused by the modified node. According to various examples, the CLUT smoothing applies to CLUTs, in general, and in particular, to CLUTs used in or in conjunction with color profiles such as, but not limited to, an International Color Consortium (ICC) profile.

According to some examples, the CLUT smoothing identifies which nodes within the CLUT are modified or altered and which nodes are unmodified with respect to an unmodified or reference CLUT, for example. The CLUT smoothing then propagates a portion of an adjustment associated with each of the identified modified nodes to adjacent, unmodified neighboring nodes. The propagated portion is weighted proportional to a relative distance between the modified node and the respective unmodified, neighboring node. Employing the distance-weighted or distance-proportional portion diminishes an effect of the propagation away from the modified node. Moreover, the portion propagated is only applied to unmodified nodes explicitly preserving the adjustment associated with the modified nodes within the CLUT, according to various examples of the principles described herein. In some examples, the CLUT smoothing may be applied iteratively.

As already mentioned, the CLUT smoothing according to principles described herein provides post-modification smoothing that explicitly preserves the modification. While profiling tools used to construct the CLUT often perform some smoothing in order to mitigate visual artifacts resulting from the construction of the CLUT, such smoothing is often ineffective or at least inappropriate for post-modification smoothing. In particular, if the CLUT has been adjusted or modified in any way (e.g. as a result of profile editing) following construction of the CLUT, artifacts may be introduced or reintroduced. Simply reapplying the profiling tool smoothing may be substantially ineffective or even counter productive since the profiling tool smoothing may alter, and in some examples, generally remove the adjustment or modification. Alteration or removal of the adjustments made to the CLUT may substantially interfere with the reasons the adjustments were made in the first place.

Herein, a color lookup table (CLUT) is defined as a data structure that maps a first color space into a second color space. The CLUT may be a CLUT of a color profile such as, but not limited to, an ICC profile, as defined by the International Color Consortium (ICC). In addition, a CLUT represents a complete color space in terms of a discrete number of nodes, herein. A quantity of the discrete number of nodes is smaller than a number of colors in the complete color space. The complete color space may be recreated from the nodes by interpolation between the nodes, according to various examples. The interpolation employs a predefined number of adjacent neighboring nodes, according to some examples.

The nodes of a CLUT are typically arranged in a mesh or lattice. In particular, a node is spaced apart from other adjacent neighboring nodes within a three dimensional (3-D) color space. In some examples, the mesh or lattice is a regular lattice in which a space between nodes is substantially uniform or constant. For example, the nodes may be arranged in a cubic mesh. A distance within the color space from a first node to a neighboring node in any principal direction is substantially similar to the distance to any other principal-direction neighboring node(s). The principal directions may be axes of the Cartesian coordinate system denoted 'X,' 'Y,' and 'Z,' for example. In other examples, the spacing between nodes in one or more principal directions within the color space is substantially non-uniform.

As used herein, the article 'a' is intended to have its ordinary meaning in the patent arts, namely 'one or more'. For example, 'a sensor' means one or more sensors and as such, 'the sensor' means 'the sensor(s)' herein. Also, any reference herein to 'top', 'bottom', 'upper', 'lower', 'up', 'down', 'front', 'back', 'left' or 'right' is not intended to be a limitation herein. Herein, the term 'about' when applied to a value generally means within the tolerance range of the equipment used to produce the value, or in some examples, means plus or minus 10%, or plus or minus 5%, or plus or minus 1%, unless otherwise expressly specified. Moreover, examples herein are intended to be illustrative only and are presented for discussion purposes and not by way of limitation.

FIG. 1 illustrates a flow chart of a method 100 of smoothing a color lookup table, according to an example of the principles described herein. According to various examples, the method 100 of smoothing applies to a color lookup table (CLUT) that has been adjusted or modified. The modified CLUT may be a CLUT in which a node has been adjusted manually, for example. For example, a user may have decide to manually adjust a node corresponding to a color such as light blue to make the color darker. In another example, the adjustment of the node may be the result of the use of a profile adjustment tool, for example. The modified CLUT may be a CLUT of a color profile and the profile adjustment tool may be used to adjust the color profile for a particular use or application (e.g., a substrate type change in a color profile of a printer). According to various examples, the method 100 of smoothing provides a post-modification, or equivalently a post-adjustment, smoothing of the modified CLUT. Moreover, the smoothing explicitly preserves the modification of the CLUT while mitigating possible artifacts associated with the modification.

The method 100 of smoothing comprises identifying 110 a modified node of the modified CLUT. The modified node is a node of the CLUT having a value that has been changed or adjusted from an original value of the node. The adjustment of the modified node is a difference between the modified node and the node prior to modification. For example, a value of the modified node may be one hundred twenty seven (127) while a value of the corresponding node prior to modification may have been one hundred twenty three (123). Therefore, the adjustment of the modified node is or has a value of four (4), for the example. In another example where node values are normalized to be between 0 and 1, the node prior to modification may have had a value of 0.6 while the modified node may have a value of 0.675 such that the adjustment is 0.075 (i.e., 0.075=0.675−0.6).

In some examples, identifying 110 a modified node employs an 'original' or unmodified CLUT corresponding to the modified CLUT. For example, the unmodified CLUT may be a copy of the modified CLUT prior to modification. Identifying 110 a modified node may comprise comparing the unmodified CLUT and the modified CLUT to locate nodes that differ, for example. Nodes that differ are then identified 110 as modified nodes, for example. The comparison may be performed on a node-by-node basis to identify substantially all of the modified nodes in the modified CLUT, according to some examples.

In another example, identifying 110 a modified node employs a list of modified nodes provided to the method 100 of smoothing. The list identifies which of the nodes of the modified CLUT have been modified by whatever process that produced the modification, for example. The list may then be used by the method 100 of smoothing to identify 110 the modified nodes. For example, the list may be generated during node modification. Specifically, the manual adjustment, profile adjustment tool, or similar means for adjusting may simply keep track of which nodes are modified to produce the list, for example. In yet other examples, the list that identifies modified nodes of the CLUT are known a priori.

The method 100 of smoothing further comprises locating 120 a neighboring node to the modified node, wherein the located neighboring node is an unmodified node. By definition, a 'neighboring node' is a node that is a member of a group of nodes within a local neighborhood of the modified node. As such, locating 120 a neighboring node only considers nodes that are within the local neighborhood. Further, locating 120 a neighboring node considers or includes only neighboring nodes that have not been modified (i.e., neighboring nodes that have an original value). As such, any modified node or nodes in the local neighborhood are or may be ignored during the neighboring node locating 120, for example.

For example, locating 120 a neighboring node may comprise defining or determining a local neighborhood of the modified node. In some examples, the local neighborhood may be defined as comprising nodes that are nearest neighbors to the modified node. For example, the nearest neighbor nodes may comprise six nodes, two in each of three principle directions (e.g., along each of an x-axis, a y-axis and a z-axis) in a three-dimensional (3-D) cubic mesh or lattice, for example. In a 3-D cubic mesh, nodes are located at corners of rectilinear 3-D polyhedra (e.g., cubes) of the cubic mesh, by definition herein. In another example, the local neighborhood may be defined as comprising twenty six nodes surrounding the modified node in a 3-D lattice. In particular, the twenty six nodes are all of the nodes at the corners of the four rectilinear polyhedra that touch and extend away from the modified node.

In yet another example, the local neighborhood may comprise nodes lying within a polyhedron surrounding the modified node. The polyhedron may be defined by a color interpolation that employs or is employed in conjunction with the CLUT. For example, the polyhedron may be a Delaunay tetrahedron. In yet other examples, the lattice of the nodes may be an arbitrary lattice and the local neighborhood may be any local neighborhood defined on or used in conjunction the arbitrary lattice. Further, a specific choice of interpolation may dictate a number of nodes that are included.

While described above with respect to a 3-D lattice, the polyhedron and the notion of local neighborhood may be defined on substantially any color space or lattice of nodes with N-dimensions, for example. In general, an N-dimensional rectangular-lattice has 2N nearest neighbors and $3^N-1$ neighboring nodes in a local neighborhood. Hence, the polyhedron and the associated local neighborhood may apply to both 3-D color spaces, described by way of example above, as well color spaces having another number of dimensions. For example, the polyhedron may be defined on and subsequently used to identify a local neighborhood with respect to a four-dimensional (4-D) CMYK color model-based color space. In another example, the polyhedron and local neighborhood is defined on a two-dimensional (2-D) chromaticity based color space.

Figure 2A:
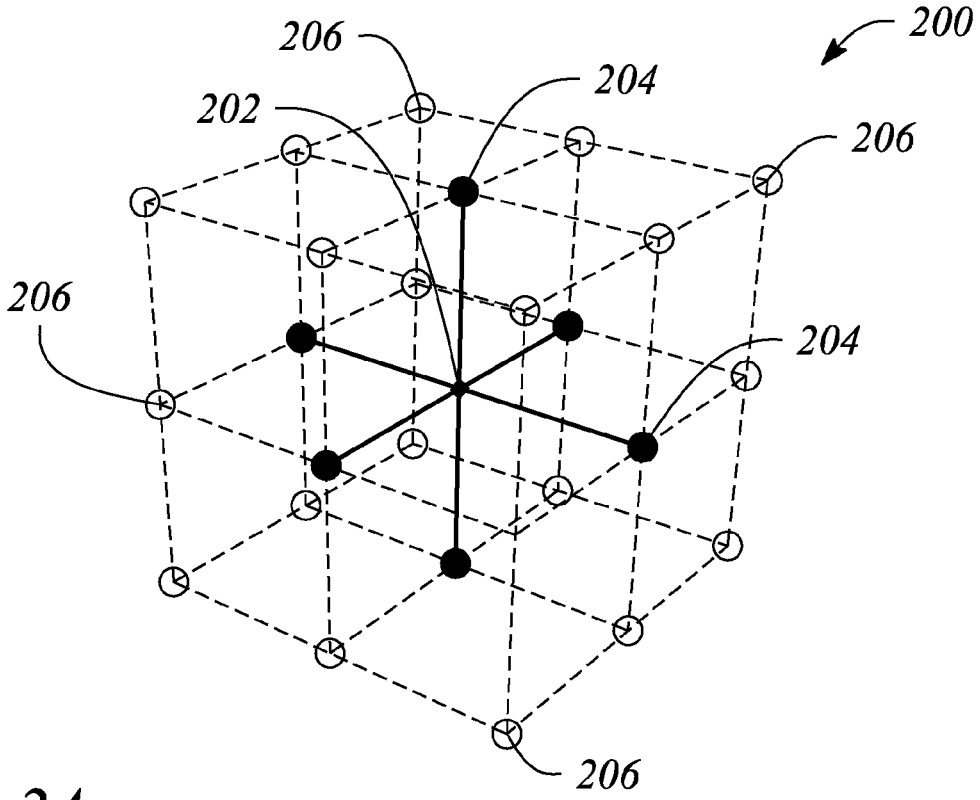
FIG. 2A illustrates a perspective view of a three-dimensional (3-D) lattice, according to an example in accordance with the principles described herein.

FIG. 2A illustrates a perspective view of a three-dimensional (3-D) lattice 200, according to an example of the principles described herein. The 3-D lattice 200 in FIG. 2A is illustrated as a cubic mesh (illustrated as dashed and solid lines) with nodes at corners the cubic mesh (illustrated as filled and open circles), by way of example. As illustrated, a modified node 202 is located at a center of the 3-D lattice 200. Also illustrated in FIG. 2A are six nearest neighbor nodes surrounding the modified node 202. The six nearest neighbor nodes 204 are illustrated as filled circles at corners of the cubic mesh in each of the three principal directions (i.e., x, y, z) of the lattice. Other neighboring nodes 206 are illustrated as open circles. Solid lines in FIG. 2A illustrate the relative distances between each of the six nearest neighbor nodes 204 and the modified node 202.

Figure 2B:
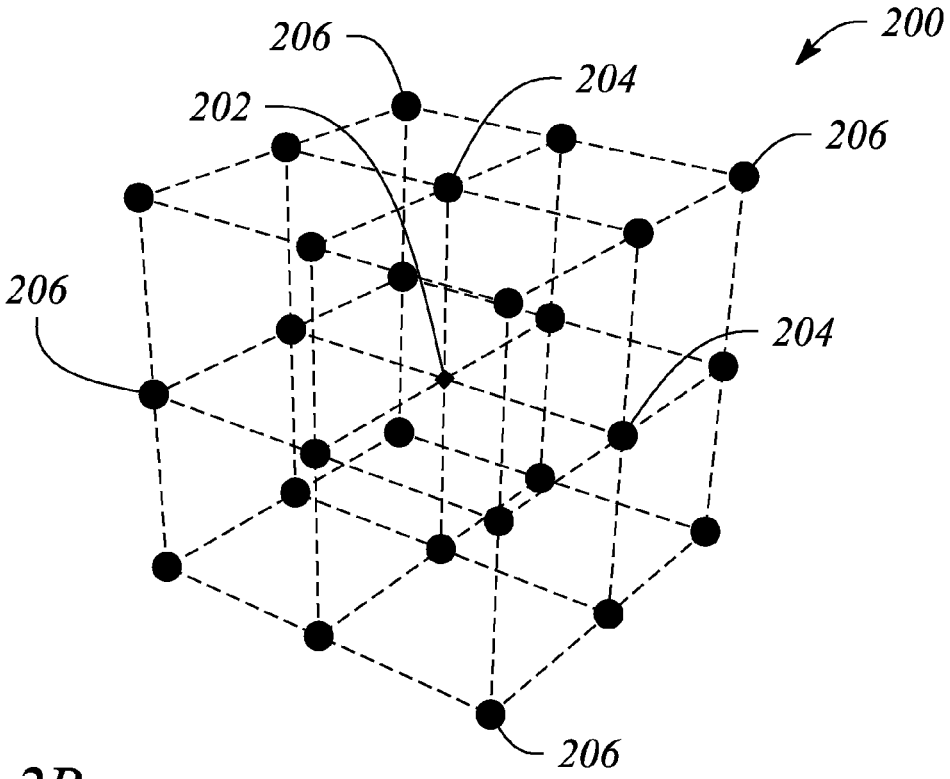
FIG. 2B illustrates a perspective view of a three-dimensional (3-D) lattice, according to another example in accordance with the principles described herein.

FIG. 2B illustrates a perspective view of a three-dimensional (3-D) lattice 200, according to another example of the principles described herein. The 3-D lattice illustrated in FIG. 2B is a cubic mesh (illustrated as dashed lines) where the local neighborhood includes all of the nodes at corners of the cubic mesh surrounding and adjacent to the modified node 202. The modified node 202 is illustrated at the center of the 3-D lattice 200 in FIG. 2B. The neighboring nodes to the modified node 202 within the local neighborhood comprise all twenty six surrounding, adjacent nodes including both the nearest neighbor nodes 204 and the other neighboring nodes 206 in FIG. 2B, as illustrated.

Locating 120 a neighboring node may further comprise examining a node within the local neighborhood to determine whether or not the node is an unmodified node. For example, the node within the local neighborhood may be compared to a corresponding node in the unmodified CLUT described above. In another example, the list of modified nodes employed in identifying 110 may be consulted. Any node that is not in the list as a modified node may be considered to be an unmodified node, for example. In yet another example, locating 120 a neighboring node may employ a list of unmodified nodes to determine whether or not a particular neighboring node is unmodified.

The method 100 of smoothing further comprises propagating 130 a portion of an adjustment of or associated with the modified node to the located unmodified neighboring node. The propagated portion of the adjustment is inversely proportional to a relative distance between the modified node and the unmodified neighboring node, according to various examples. For example, the propagated portion of the adjustment may be weighted according to the relative distance. In particular, an amount of the weighting may be inversely proportional to the relative distance, for example. In some examples, the weighting may be linearly inversely proportional to the relative distance. For example, the relative distance may be normalized to lie between 0 and 1.0 with 1.0 being a closest distance and 0 being a furthest distance. The weighting may then be the normalized relative distance (e.g., a number between 0 and 1.0), for example. In other examples, a non-linear weighting may be employed. For example, an exponential weighting or a quadratic weighting may be employed.

For example, a value of the adjustment of the modified node may be 5. A relative distance between the modified node and the located 120 unmodified neighboring node may yield a weighting of 0.4. The propagated portion p of the adjustment may be a product of the adjustment (e.g., 5) and the weighting (e.g., $p=0.3\cdot 5$), for example. In another example, the adjustment may have a value of 25 and the weighting for three neighboring nodes at three successively greater relative distances may be 0.6, 0.4 and 0.1, respectively. The propagated portion p of the adjustment is 15, 10 and 2.5, respectively for the three neighboring nodes of the example. In yet another example, the weighting w may be an exponential function given by equation (1)

$$w=e^{-\alpha\cdot d} \tag{1}$$

where $e^x$ is an exponential function, d is the relative distance and a is an arbitrary positive constant. For an example relative distance of d equal to 0.6 and a constant $\alpha$ equal to 1.0, the propagated portion for an adjustment value of 25 would be about 14 (e.g., $p=w\cdot 25=13.72$), for example.

In addition to being weighted inversely proportional to the relative distance, the propagated portion may be scaled by a scale factor. For example, the scale factor may be constant scale factor. The scale factor may be used to ensure that less than a total amount of the adjustment is propagated to a nearest neighboring node. For example, the scale factor may be one half (0.5), in some examples. In some examples, the scale factor may be a function of location (e.g., color) within the CLUT. As such, the scale factor may be a variable scale factor, in some examples. In some examples, the scale factor may be combined with the weighting described above.

In some examples, propagating 130 a portion of an adjustment comprises combining the propagated portion of the adjustment with a value of the unmodified neighboring node. For example, the propagated portion of the adjustment may be added to a value of the unmodified neighboring node. Adding may include further scaling the propagated portion, in some examples. For example, combining the propagated portion with the unmodified neighboring node value may comprise forming an average of the propagated portion of the adjustment from the modified node with propagated portions of an adjustment from a plurality of other modified nodes that neighbor the unmodified neighboring node. The average may then be added to the value of the unmodified neighboring node, for example.

In some examples, propagating 130 a portion is performed in a color space that is perceptually uniform. For example, a perceptually uniform color space may be the Commission Internationale de L'éclairage (CIE) L* a* b* (CIELAB) color space. In some examples, the CLUT is used in or is a CLUT of an International Color Consortium (ICC) profile.

Figure 3:
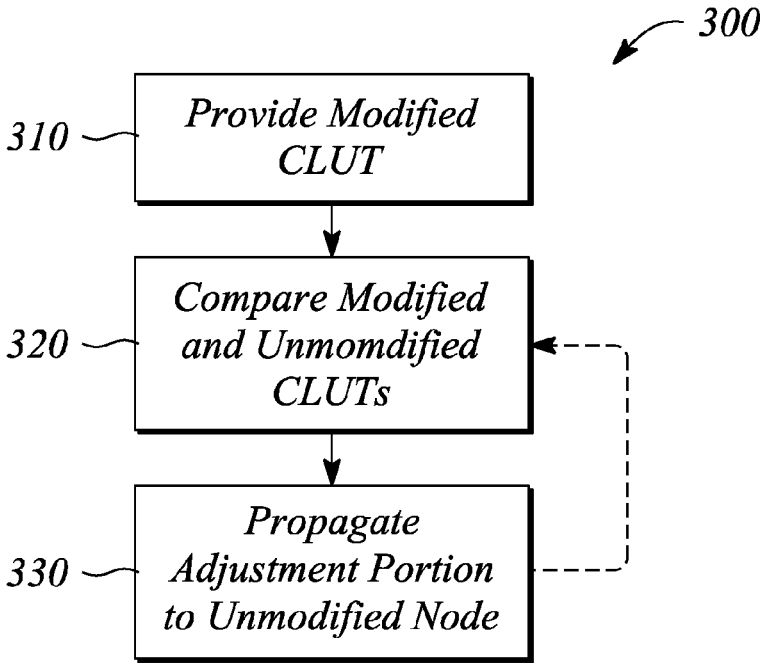
FIG. 3 illustrates a flow chart of a method of color lookup table smoothing, according to an example in accordance with the principles described herein.

FIG. 3 illustrates a flow chart of a method 300 of color lookup table smoothing, according to another example of the principles described herein. The method 300 of color lookup table smoothing comprises providing 310 a modified color lookup table (CLUT). The provided CLUT has a node that is modified. The modified CLUT having a modified node may be substantially similar to the modified CLUT describe above with respect to the method 100 of smoothing, according to some examples.

The method 300 of color lookup table smoothing further comprises comparing 320 the modified CLUT to a corresponding CLUT that is unmodified. The corresponding unmodified CLUT may be substantially similar to the unmodified CLUT described above with respect to the method 100 of smoothing, according to some examples. For example, the unmodified CLUT may be the modified CLUT prior to modification. Comparing 320 the modified CLUT to the corresponding unmodified CLUT is used to identify the modified nodes in the modified CLUT and the nodes that are unmodified. For example, comparing 320 the modified CLUT to the corresponding unmodified CLUT may produce a list of modified nodes and unmodified nodes, for example. The list may identify each of the modified nodes and unmodified nodes in the modified CLUT, for example.

The method 300 of color lookup table smoothing further comprises propagating 330 to an identified unmodified node a portion of an adjustment associated with each of a plurality of modified nodes that neighbor the identified unmodified node. According to various examples, the propagated portions of the adjustments are inversely proportional to a relative distance between the unmodified node and respective ones of the neighboring modified nodes. Moreover, neighboring modified nodes of the unmodified node are modified nodes within a local neighborhood of the unmodified node. In some examples, the local neighborhood and, by extension, the neighboring nodes are substantially similar to the local neighborhood and the neighboring nodes described and defined above with respect to the method 100 of smoothing.

In particular, in some examples the modified CLUT comprises a cubic mesh of nodes and the neighboring modified nodes are modified nodes included among twenty six nodes in the cubic mesh adjacent to the unmodified node. In other examples, the neighboring modified nodes are modified nodes among six nearest neighbor nodes to the unmodified node. In some examples, neighboring modified nodes to the unmodified node comprise modified nodes in a polyhedron surrounding and centered on the unmodified node. The polyhedra may be defined by a color interpolation that employs the CLUT, for example.

In some examples, propagating 330 an adjustment portion to the unmodified node comprises adjusting a value of the unmodified node with an average of the propagated portions of the adjustment from each neighboring modified node in the plurality. For example, propagated portions from all of the neighboring modified nodes in the plurality may be added together and then the sum divided by a number of the neighboring modified nodes in the plurality. As described above, the propagated portions are weighted inversely proportional to the relative distance between the unmodified node and the various neighboring modified nodes. The inverse proportional weighting may be substantially similar to the weighting described above with respect to the method 100 of smoothing, according to some examples.

In some examples, the method 300 of color lookup table smoothing further comprises iteratively comparing and propagating (e.g., as indicated by a dashed line in FIG. 3). In particular, according to some examples, the method 300 may further comprise comparing the modified CLUT to a corresponding unmodified CLUT to re-identify modified nodes and unmodified nodes in the modified CLUT after propagating 330 the adjustment portion. The re-identified modified nodes may include previously unmodified nodes that were adjusted during propagating 330, for example. The method 300 of color lookup table smoothing may further comprise propagating to a re-identified unmodified node a portion of an adjustment in each of a plurality of re-identified modified nodes that neighbor the re-identified unmodified node, according to these examples. The propagated portions of the adjustment are inversely proportional to a relative distance between the re-identified unmodified node and respective ones of the re-identified neighboring modified nodes, according to some examples.

Figure 4:
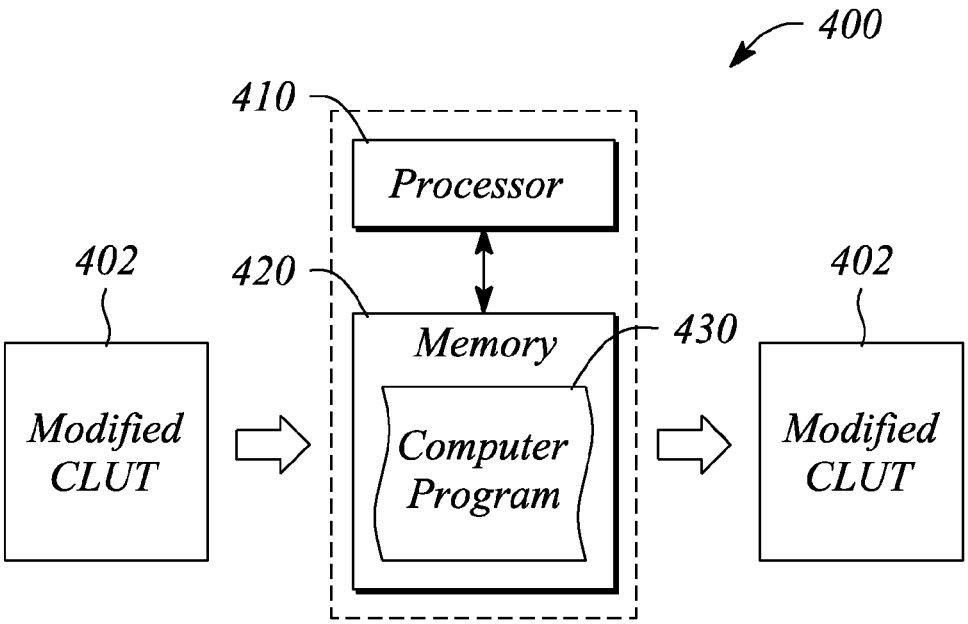
FIG. 4 illustrates a block diagram of a color lookup table smoothing system, according to an example in accordance with the principles described herein.

FIG. 4 illustrates a block diagram of a color lookup table smoothing system 400, according to an example of the principles described herein. The color lookup table smoothing system 400 may be used to smooth a modified color lookup table (CLUT) 402, for example.

As illustrated in FIG. 4, the color lookup table smoothing system 400 comprises a processor 410 and memory 420. The processor 410 is configured to access the memory 420, as indicated by the double-headed arrow in FIG. 4. For example, the processor 410 may be a central processing unit (CPU) of a general-purpose computer. The processor 410 may be implemented as a microprocessor, for example. In another example, the processor 410 may be an embedded processor, microprocessor, or a related CPU in a device including, but not limited to, a scanner, a printer and a camera. In yet another example, the processor 410 may be a specialized processor such as, but not limited to, an image processor.

The memory 420 may be any memory that is or may be accessed by the processor 410. For example, the memory 420 may be random access memory (RAM), read only memory (ROM), a magnetic or optical drive (e.g., computer hard disk) or another disk drive of a general-purpose computer that either includes or is connected to the processor 410. In another example, the memory 420 comprises removable media including, but not limited to, floppy disk, a compact disk (CD), a digital versatile disk (DVD), and a memory card (e.g., a USB flash drive). In some embodiments, one or both of the processor 410 and the memory 420 are implemented as an application specific integrated circuit (ASIC).

As illustrated in FIG. 4, the color lookup table smoothing system 400 further comprises a computer program 430 stored in the memory 420 to be executed by the processor 410. The computer program 430 comprises instructions that, when executed, implement identifying a modified node of the modified CLUT 402. In some examples, identifying a modified node implemented by the instructions of the computer program 430 is substantially similar to identifying 110 a modified node described above with respect to the method 100 of smoothing a color lookup table.

The computer program 430 further comprises instructions that, when executed, implement locating a neighboring unmodified node to the modified node. In some examples, locating a neighboring unmodified node implemented by the instructions of the computer program 430 is substantially similar to locating 120 described above with respect to the method 100 of smoothing a color lookup table.

The computer program 430 further comprises instructions that, when executed, implement propagating a portion of an adjustment associated with the modified node to the located neighboring unmodified node to produce a modified CLUT 402. The propagated portion of the adjustment is inversely proportional to a relative distance between the modified node and the neighboring unmodified node. In some examples, propagating a portion of an adjustment implemented by the instructions of the computer program 430 is substantially similar to propagating 130 a portion of an adjustment described above with respect to the method 100 of smoothing a color lookup table.

In some examples, one or both of the modified CLUT 402 and a corresponding unmodified CLUT is stored in the memory 420. In some examples, the modified node is identified by instructions that implement comparing the modified CLUT 402 to the corresponding unmodified CLUT. In other examples, a list of one or both of modified nodes and unmodified nodes are stored in the memory 420. The modified node may be identified by instructions that implement consulting the stored list, for example.

In particular, the computer program 430 comprises the instructions that implement comparing the modified CLUT 402 stored in the memory 420 to the corresponding unmodified CLUT stored in the memory 420, for example, to identify the modified and unmodified nodes in the modified CLUT. In other examples, the computer program 430 comprises the instructions that implement consulting the stored list to identify the one or more modified and unmodified nodes. In some examples, the comparison of the modified CLUT to an unmodified CLUT that is implemented by the instructions of the computer program 430 is substantially similar to comparing 320 described above with respect to the method 300 of color lookup table smoothing.

Further, the computer program 430 may comprise instructions that implement propagating to an identified unmodified node a portion of an adjustment in each of a plurality of modified nodes that neighbor the unmodified node. In some examples, the propagating that is implemented by the instructions of the computer program 430 is substantially similar to propagating 330 described above with respect to the method 300 of color lookup table smoothing.

Thus, there have been described examples of a method and a system of smoothing a color lookup table that employ adjustment propagation. It should be understood that the above-described examples are merely illustrative of some of the many specific examples that represent the principles described herein. Clearly, those skilled in the art can readily devise numerous other arrangements without departing from the scope as defined by the following claims.

What is claimed is:

1. A method of smoothing a color lookup table, the method comprising:

identifying a modified node of the color lookup table (CLUT);

locating a neighboring node to the modified node, the located neighboring node being unmodified; and propagating a portion of an adjustment of the modified node to the located unmodified neighboring node, wherein one or more of identifying a modified node, locating a neighboring node, and propagating a portion of an adjustment is performed by a processor.

2. The method of smoothing of claim 1, wherein the modified node is identified by comparing the CLUT to a corresponding CLUT having no modified nodes and wherein the propagated portion of the adjustment is inversely proportional to a relative distance between the modified node and the unmodified neighboring node.

3. The method of smoothing of claim 1, wherein the neighboring node is a member of a set of six nearest neighbors to the modified node.

4. The method of smoothing of claim 1, wherein locating the neighboring node comprises identifying nodes in a polyhedron surrounding and centered on the modified node, the polyhedron being defined by a color interpolation that employs the CLUT.

5. The method of smoothing of claim 1, wherein the CLUT comprises a cubic mesh of nodes, the neighboring nodes comprising twenty six nodes in the cubic mesh adjacent to the modified node.

6. The method of smoothing of claim 1, wherein propagating the portion of the adjustment comprises combining the propagated portion of the adjustment with a value of the unmodified neighboring node.

7. The method of smoothing of claim 6, wherein combining the propagated portion comprises:

forming an average of the propagated portion of the adjustment from the modified node with propagated portions of an adjustment from a plurality of other modified nodes that neighbor the unmodified neighboring node; and adding the formed average to the value of the unmodified neighboring node.

8. The method of smoothing of claim 1, wherein propagating the portion of the adjustment is performed in a color space that is perceptually uniform.

9. The method of smoothing of claim 1, wherein the CLUT is defined in conjunction with an ICC profile.

10. A method of color lookup table smoothing, the method comprising:

providing a modified color lookup table (CLUT) having a node that is modified;

comparing the modified CLUT to a corresponding CLUT that is unmodified to identify the modified node and nodes in the CLUT that are unmodified; and propagating to an identified unmodified node a portion of an adjustment in each modified node of a plurality of the modified nodes that neighbor the identified unmodified node, wherein the propagated portions of the adjustments are inversely proportional to a relative distance between the identified unmodified node and respective ones of the neighboring modified nodes, and wherein one or more of providing a modified CLUT, comparing the modified CLUT, and propagating to an identified unmodified node is performed by a processor.

11. The method of color lookup table smoothing of claim 10, wherein the modified CLUT comprises a cubic mesh of nodes, the neighboring modified nodes being modified nodes included among twenty six nodes in the cubic mesh adjacent to the identified unmodified node.

12. The method of color lookup table smoothing of claim 10, wherein the neighboring modified nodes to the identified unmodified node comprise modified nodes in a polyhedron surrounding and centered on the identified unmodified node, the polyhedral being defined by a color interpolation that employs the CLUT.

13. The method of color lookup table smoothing of claim 10, wherein propagating the portion of the adjustment comprises adjusting a value of the identified unmodified node with an average of the propagated portions of the adjustments from each neighboring modified node in the plurality.

14. The method of color lookup table smoothing of claim 10, further comprising:

comparing the modified CLUT to a corresponding unmodified CLUT after propagating the portion of the adjustment to re-identify modified nodes and to re-identify unmodified nodes in the modified CLUT, the re-identified modified nodes including previously unmodified nodes that were adjusted during the propagating; and propagating to a re-identified unmodified node a portion of an adjustment in each modified node of a plurality of re-identified modified nodes that neighbor the re-identified unmodified node, wherein the propagated portions of the adjustment are inversely proportional to a relative distance between the re-identified unmodified node and respective ones of the neighboring re-identified modified nodes.

15. The method of color lookup table smoothing of claim 10, wherein the modified CLUT is provided in conjunction with an ICC profile.

16. A color lookup table smoothing system comprising:

a memory; and a computer program stored in the memory to be executed by a processor, the computer program comprising instructions that, when executed, implement identifying a modified node of a color lookup table (CLUT), locating a neighboring node to the modified node, the neighboring node being unmodified, and propagating a portion of an adjustment of the modified node to the unmodified neighboring node, wherein the propagated portion of the adjustment is inversely proportional to a relative distance between the modified node and the unmodified neighboring node.

17. The color lookup table smoothing system of claim 16, wherein the CLUT and a corresponding unmodified CLUT are further stored in the memory, the modified node being identified by instructions that implement comparing the CLUT to the corresponding unmodified CLUT.

18. The color lookup table smoothing system of claim 16, wherein the unmodified neighboring node is a member of a set of nodes in a polyhedron surrounding and centered on the modified node, the polyhedral being defined by a color interpolation that employs the CLUT.

19. The color lookup table smoothing system of claim 16, wherein the instructions that implement propagating a portion of an adjustment comprise instructions that combine the portion of the adjustment with a value of the unmodified neighboring node.

20. The color lookup table smoothing system of claim 16, wherein the CLUT is provided in conjunction with an ICC profile.

* * * * *